US010710825B2

(12) United States Patent
Lo

(10) Patent No.: US 10,710,825 B2
(45) Date of Patent: Jul. 14, 2020

(54) CART CHASIS

(71) Applicant: Hewlett-Packard Development Company, L.P., Houston, TX (US)

(72) Inventor: Kevin Lo, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/064,221

(22) PCT Filed: Apr. 4, 2016

(86) PCT No.: PCT/US2016/025932

§ 371 (c)(1),
(2) Date: Jun. 20, 2018

(87) PCT Pub. No.: WO2017/176249

PCT Pub. Date: Oct. 12, 2017

(65) Prior Publication Data

US 2019/0002221 A1 Jan. 3, 2019

(51) Int. Cl.

| | |
|---|---|
| ***G03G 21/00*** | (2006.01) |
| ***B65H 1/26*** | (2006.01) |
| ***B65H 1/04*** | (2006.01) |
| ***B41J 13/10*** | (2006.01) |
| ***G03G 21/16*** | (2006.01) |

(52) U.S. Cl.

CPC ..... *B65H 1/266* (2013.01); *B41J 13/103* (2013.01); *B65H 1/04* (2013.01); *G03G 21/1619* (2013.01); *B65H 2402/10* (2013.01); *B65H 2402/30* (2013.01); *B65H 2402/45* (2013.01); *B65H 2405/15* (2013.01); *B65H 2405/312* (2013.01); *B65H 2405/332* (2013.01)

(58) Field of Classification Search

CPC ..... B65H 1/266; B65H 1/04; B65H 2402/10; B65H 2402/30; B65H 2402/45; B65H 2405/15; B65H 2405/312; B65H 2405/332; B41J 13/103; G03G 21/1619

See application file for complete search history.

(56) References Cited

U.S. PATENT DOCUMENTS

| | | | |
|---|---|---|---|
| 4,580,775 | A | 4/1986 | Maruyama |
| 5,835,820 | A | 11/1998 | Martin et al. |
| 6,646,768 | B1 | 11/2003 | Anderson et al. |
| 8,833,757 | B1 | 9/2014 | Piening et al. |
| 2004/0190940 | A1 | 9/2004 | Sasoh et al. |
| 2005/0190392 | A1 | 9/2005 | Carroll |
| 2006/0239771 | A1 | 10/2006 | Hayashi et al. |

(Continued)

FOREIGN PATENT DOCUMENTS

| | | | |
|---|---|---|---|
| CN | 1506232 | A | 6/2004 |
| CN | 1541922 | A | 11/2004 |

(Continued)

OTHER PUBLICATIONS

Web Page. Lanier Sevin Ricoh. MP 3353 Multifunction Printer Review Copier Guide. Retrieved on Mar. 4, 2016 ~ 6 pages.

*Primary Examiner* — Hoang X Ngo
(74) *Attorney, Agent, or Firm* — Fabian VanCott

(57) ABSTRACT

A cart chassis is described which includes: multiple areas inside the chassis to accommodate either of two different types of modular accessory trays in multiple configurations. An upper platform of the chassis is to support a print engine.

15 Claims, 7 Drawing Sheets

(56) References Cited

U.S. PATENT DOCUMENTS

| | | | | |
|---|---|---|---|---|
| 2009/0116865 | A1 | 5/2009 | Hanano | |
| 2014/0001698 | A1 | 1/2014 | Okano et al. | |
| 2014/0328606 | A1* | 11/2014 | Katsuyama ..... | G03G 15/0189 399/92 |
| 2015/0000080 | A1 | 1/2015 | Matsuoka | |
| 2015/0298923 | A1 | 10/2015 | Akagawa | |

FOREIGN PATENT DOCUMENTS

| | | | |
|---|---|---|---|
| CN | 104137004 | A | 11/2014 |
| WO | WO-2015013179 | A1 | 1/2015 |

* cited by examiner

CART CHASIS

BACKGROUND

Many organizations need a number of printing devices with significant capacity to produce the hardcopy documents used by the enterprise. These printing devices may store amounts of print media to be used in document production.

BRIEF DESCRIPTION OF THE DRAWINGS

The accompanying drawings illustrate various implementations of the principles described herein and are a part of the specification. The illustrated implementations are merely examples and do not limit the scope of the claims.

Throughout the drawings, identical reference numbers designate similar, but not necessarily identical, elements.

DETAILED DESCRIPTION

Figure 1:
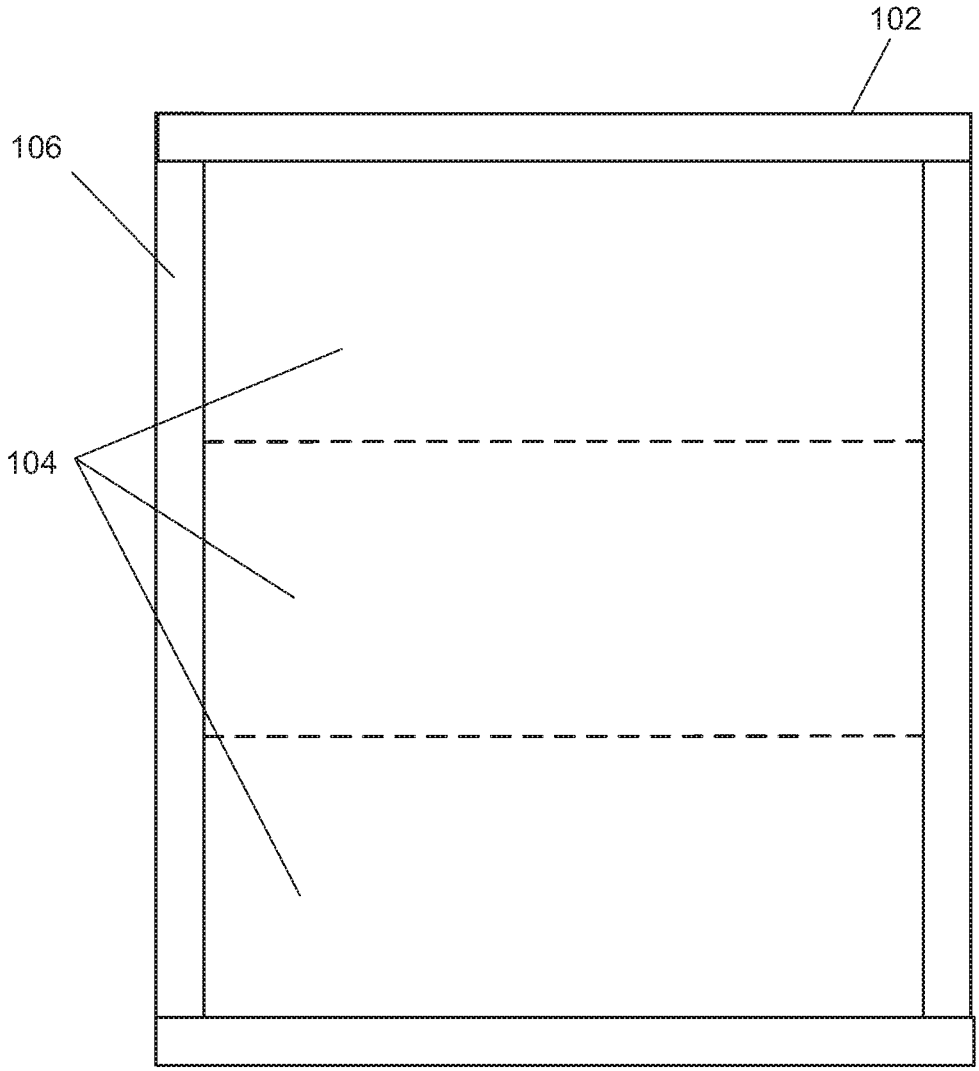
FIG. 1 is an illustration of an example cart chassis, consistent with the disclosed implementations.

As noted above, many organizations need a number of printing devices with significant capacity to produce the hardcopy documents used by the enterprise. These printing devices may store amounts of print media to be used in document production.

A typical printing device for a larger organization will include two major components. The first is the print engine, which includes the mechanisms for selectively applying a marking material to a print medium to form images or text as desired in a resulting hardcopy document. The print engine component may also include a number of trays for storing a print medium for use by the print engine. Such a print engine may be deployed alone as a printer.

However, the print engine is often mounted on the second of the two major components, a cart. The cart supports the print engine and, within its chassis, may provide additional supplies of print medium along with a feeding system for feeding that print medium to the print engine.

Depending on many factors, different organizations may want printing devices with different capacities and configurations. For example, one purchaser may want a printing device with maximum capacity to store print medium in the printing device so that production can occur with minimal interruption to resupply the print medium. In other examples, a purchaser may prefer to have storage space for other items besides print media at the printing device.

While additional print medium supply space or general storage space can be provided in the cart chassis of a printing device, different configurations and functionality will appeal to different users. Consequently, to accommodate the varying desires of different users, the present specification describes the following.

In one example, the present specification describes a cart chassis including: multiple areas inside the chassis to accommodate either of two different types of modular accessory trays in multiple configurations; and an upper platform of the chassis to support a print engine.

In another example, the present specification describes a printing device including: a print engine; a cart chassis, the cart chassis including: multiple areas inside the chassis to accommodate either of two different types of modular accessory trays in multiple configurations; and an upper platform of the chassis to support the print engine; and two modular accessory trays sized for installation in the multiple areas inside the chassis.

In another example, the present specification describes a method of customizing a cart for a printing device, the cart comprising a chassis having multiple internal areas to accommodate either of two different types of modular accessor trays in multiple configurations by: installing at least two different modular accessory trays inside the chassis, each of the two different accessory trays being one of a group comprising a print media tray to supply a print medium and a storage tray to provide storage space.

As used herein and in the following claims, the term "type" of modular accessory tray refers to the fact that different types of modular accessory trays may have different functions and purposes, and consequently, different structure. For example, one type of modular accessory tray is a "print media tray" which is defined as being a tray equipped to hold a supply of print medium and interface with a print medium feeding system to provide the contained print medium to a print engine. Another type of modular accessory tray is a "storage tray" which is defined as a tray equipped to provide general storage space without interfacing with a print medium feeding system to feed print media.

As used herein and in the following claims, the term "modular" refers to the design of the accessory trays as each being a self-contained module that can be installed equally well in different areas within a corresponding cart chassis.

As used herein and in the following claims, the term "configuration" of modular accessory trays refers to the selection and relative placement of different modular accessory trays inside the chassis of the cart of a printing device. For example, some configurations may include different types of modular accessory trays. Thus, one configuration may include a storage tray and one or more print media trays. Another configuration may include only a number of print media trays. In another configuration, a storage tray may be below a print media tray, while in another configuration, the storage tray may be above the print media tray.

In the following description, for purposes of explanation, specific details are set forth in order to provide a thorough understanding of the disclosure. It will be apparent, however, to one skilled in the art that examples consistent with the present disclosure may be practiced without these specific details. Reference in the specification to "an implementation," "an example" or similar language means that a particular feature, structure, or characteristic described in connection with the implementation or example is included in at least that one implementation, but not necessarily in other implementations. The various instances of the phrase "in one implementation" or similar phrases in various places in the specification are not necessarily all referring to the same implementation.

FIG. 1 is an illustration of an example cart chassis, consistent with the disclosed implementations. As shown in FIG. 1, a cart chassis (106) includes an upper platform (102) on which to support a print engine, as will be illustrated and described below.

Inside the chassis, a number of areas (104) are arranged to accommodate either of two different types of modular accessory trays in multiple configurations. In the illustrated example, three equally sized areas (104) are shown. However, any number of areas of equal or different sizes could be provided.

In the illustrated example, a print media tray could be installed in each of the three areas (104). Alternatively, a print media tray could be installed in one of the areas (104), while a storage tray could occupy both of the other two areas (104).

The chassis shown in FIG. 1 readily allows for different configurations of accessory trays to be provided within the same chassis structure (106). Thus, different types of trays or trays in different arrangements can be installed as suits the needs of a particular user.

Figure 2:
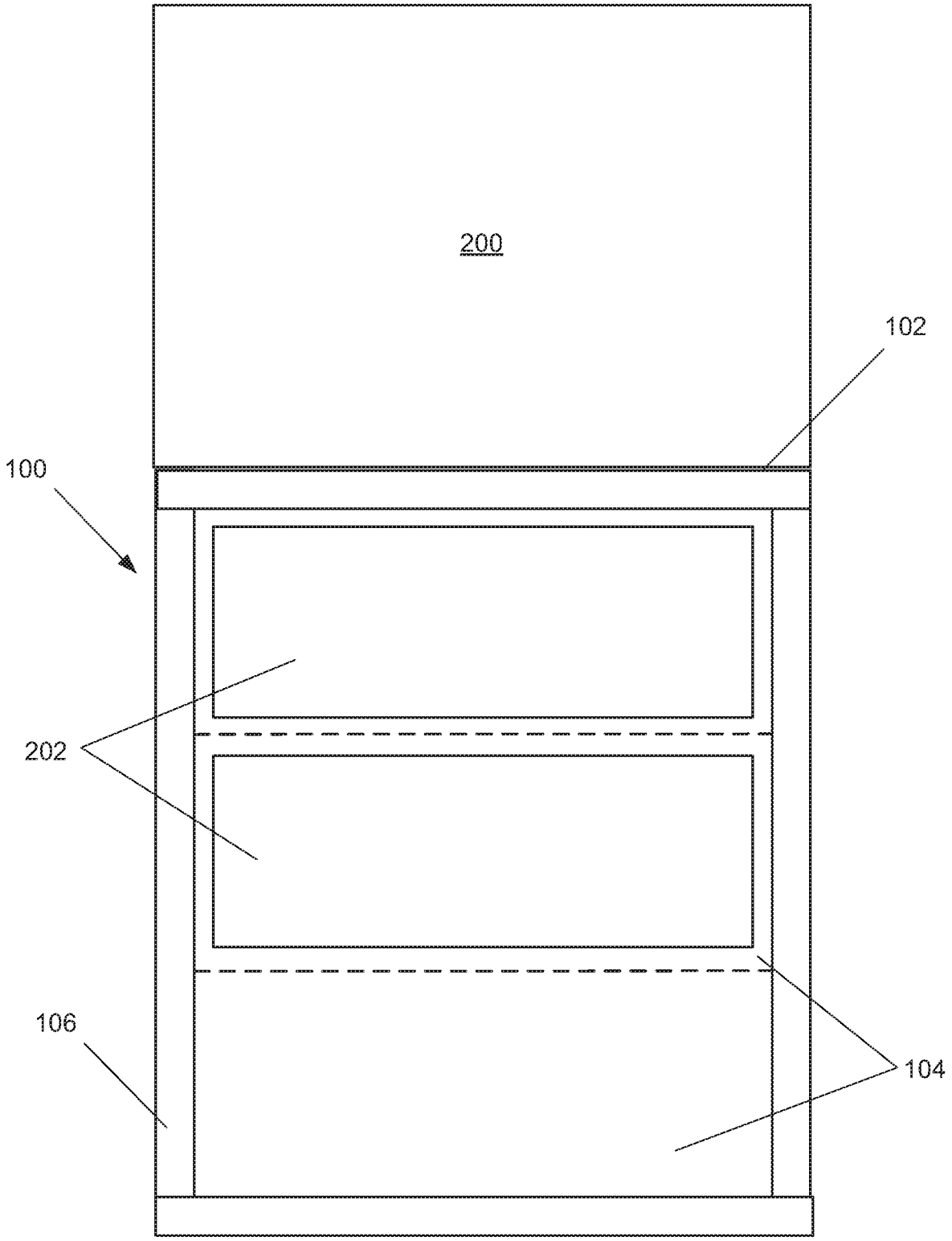
FIG. 2 is an illustration of an example printing device including a print engine and cart, consistent with the disclosed implementations.

FIG. 2 is an illustration of an example printing device including a print engine and cart, consistent with the disclosed implementations. As shown in FIG. 2, a print engine (200) has been installed atop the cart (100).

Inside the chassis (106), two accessory trays (202) are shown installed in two of the areas (104) sized to receive such trays. These trays (202) may be of the same or different types. For example, both may be print media trays or one may be a print media tray while the other is a storage tray.

Figure 3:
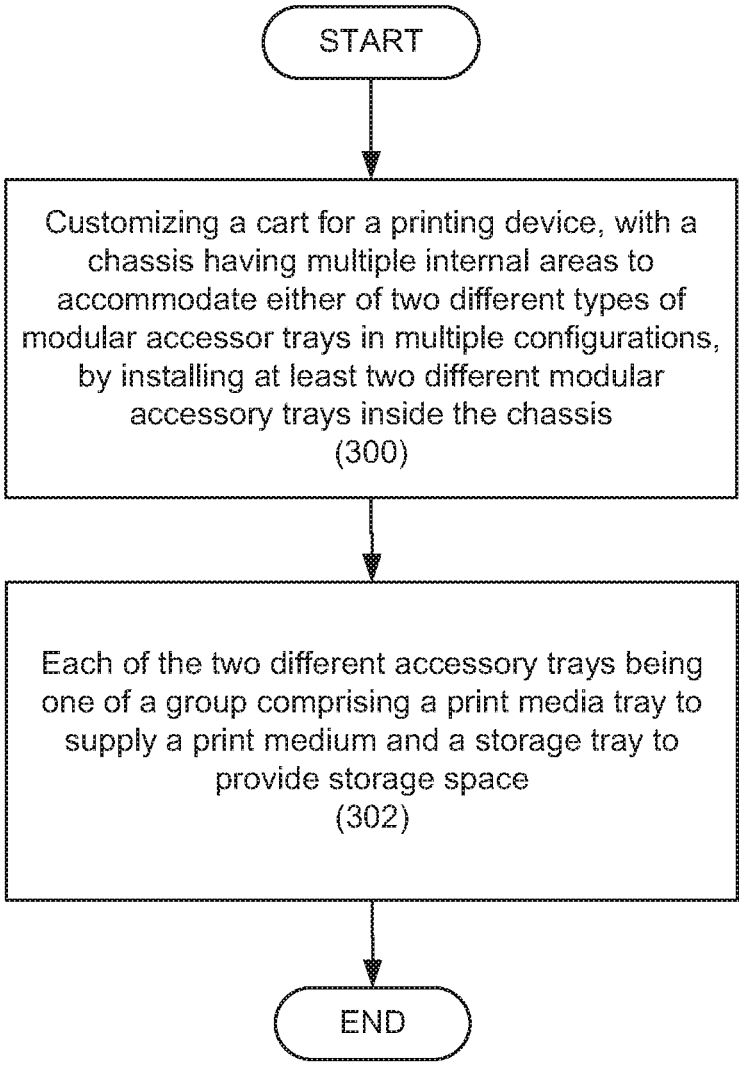
FIG. 3 is a flowchart of an example method of customizing a printing device, consistent with the disclosed implementations.

FIG. 3 is a flowchart of an example method of customizing a printing device, consistent with the disclosed implementations. As shown in FIG. 3, the method uses a cart comprising a chassis having multiple internal areas to accommodate either of two different types of modular accessor trays in multiple configurations. The method then includes installing (300) at least two different modular accessory trays inside the chassis, where each of the two different accessory trays being (302) one of a group comprising a print media tray to supply a print medium and a storage tray to provide storage space.

Figure 4:
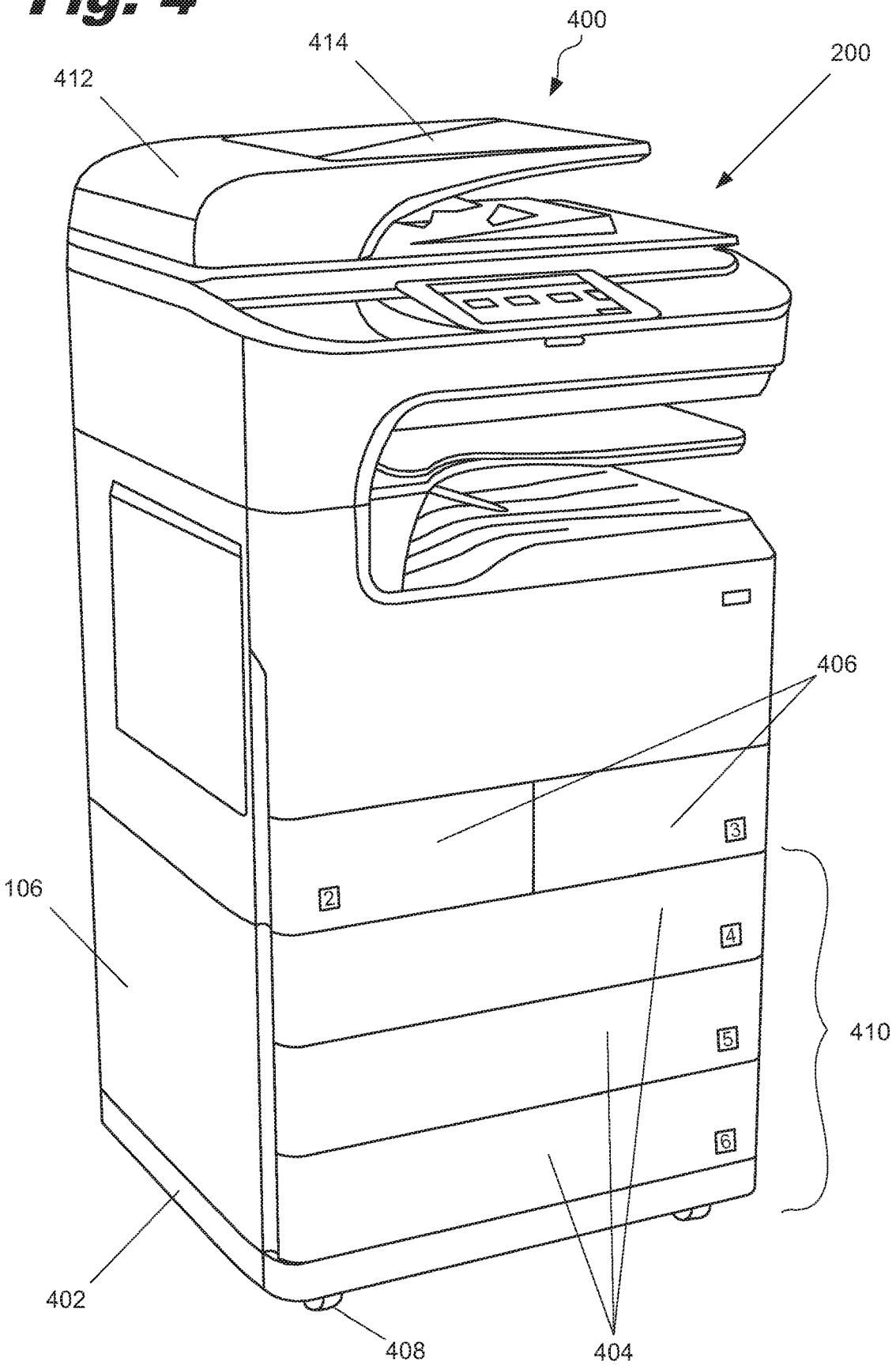
FIG. 4 is an illustration of a printing device, consistent with the disclosed implementations.

FIG. 4 is an illustration of a printing device (400), consistent with the disclosed implementations. As shown in FIG. 4, a print engine (200) is installed on a cart (410). As described here, the print engine (200) generally includes the components illustrated above the bracket (410) designating the cart. Consequently, the print engine (200) includes the components for selectively apply a printing material, such as ink or toner, to a print medium, such as paper, to produce a hardcopy document based on digital data provided to the print engine (200) as a print job. The print engine (200) may also include its own print medium supply trays (406). In FIG. 4, two such print medium supply trays (406) are shown integrated into the print engine in a side-by-side configuration. Additionally, in FIG. 4, the print engine (200) is topped with a finishing module (412) having its own output tray (414).

The cart (410) of the illustrated printing device (400) includes a chassis (106). The chassis (106) rests on a skateboard (402), which is provided with wheels (408). This facilitates movement of the printing device (400) for repair, maintenance or relocation.

The cart (410) of the illustrated printing device (400) also includes three accessory trays (404), each of which is a print media tray in this example. As will be illustrated and described in more detail below, each print media tray (404) includes or utilizes a print media feeding system so as to feed print media from that tray to the print engine (200).

This configuration with three print media trays (404) in the cart (410) suits a user who wants maximum storage of print media in the printing device (400). In this way, the printing device (400) can operate with a minimum of attention to resupply print media.

As also illustrated in the example of FIG. 4, the chassis has an uninterrupted surface spanning between adjacent accessory trays. This uninterrupted surface is illustrated, for example, by the panel on the left in FIG. 4 indicated by reference number 106 and the corresponding arrow.

Figure 5:
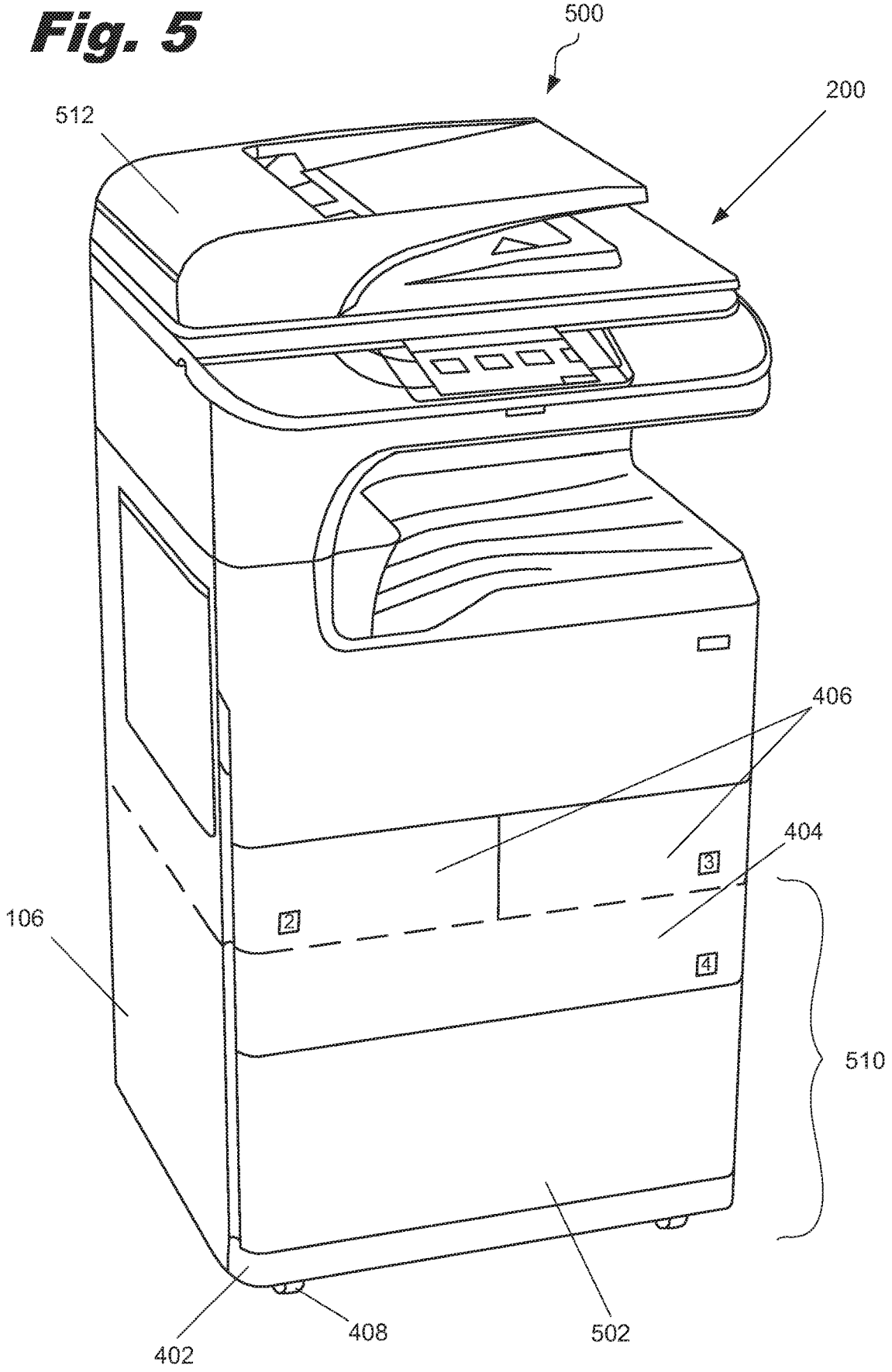
FIG. 5 is another illustration of a printing device, consistent with the disclosed implementations.

FIG. 5 is another illustration of a printing device (500), consistent with the disclosed implementations. In this example, the print engine (200) is the same as described above in connection with FIG. 4, except that the print engine (200) is topped by a spacer module (512). However, the cart (510) is configured differently. In FIG. 5, the cart (510) has been provisioned with a print media tray (404). However, below the print media tray (404), two of the areas in the chassis (106) for receiving accessory trays have been occupied by a storage tray (502).

The storage tray (502) provides general storage for any articles the user wishes to keep at the printing device (500). The storage tray (502) could be used to store print media. However, the difference between a print media tray (404) and a storage tray (502) is that the storage tray (502) does not have or utilize a feeding system so as to be able to feed print media to the print engine (200).

Figure 6:
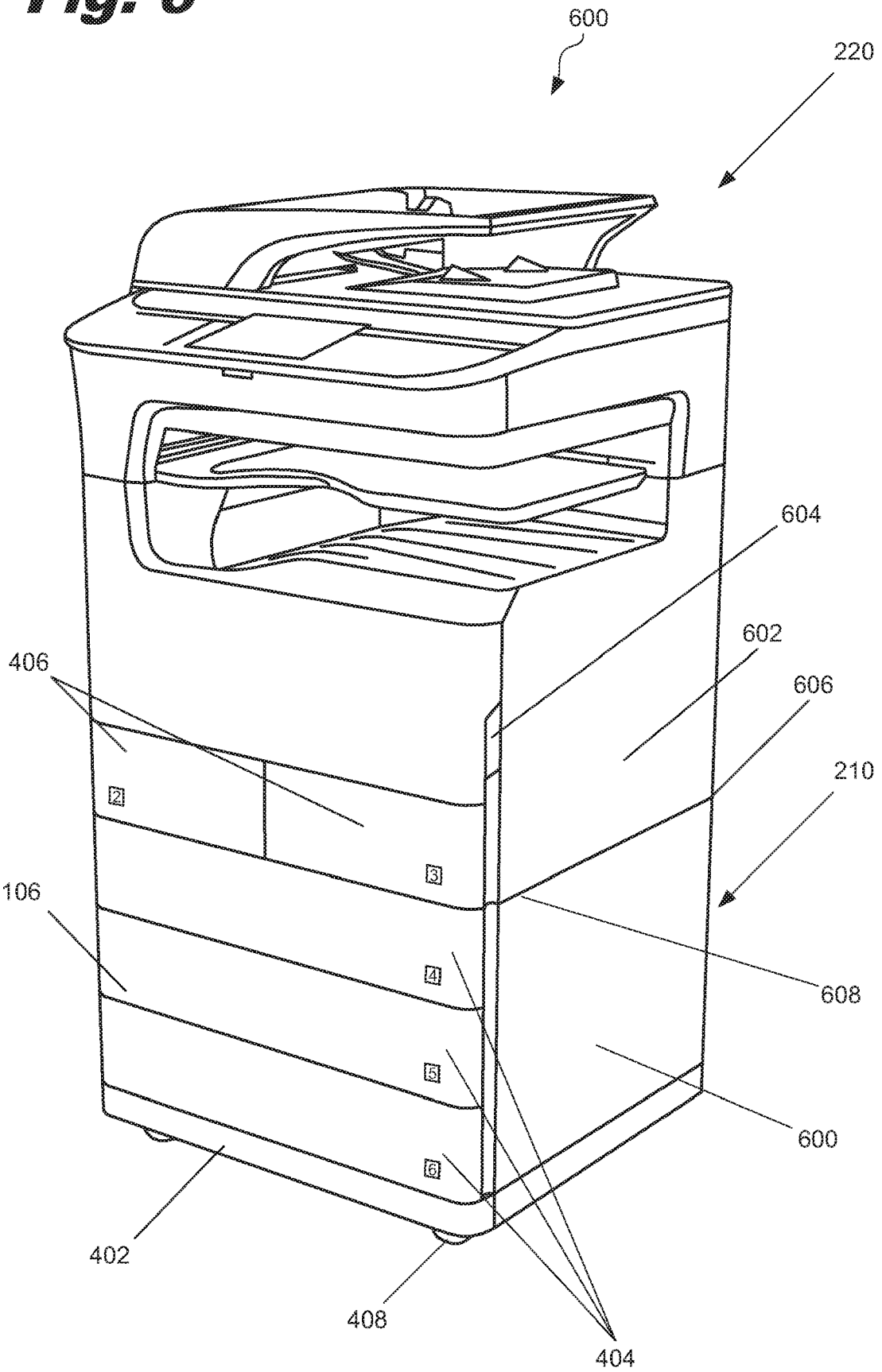
FIG. 6 is another illustration of a printing device, consistent with the disclosed implementations.

FIG. 6 is another illustration of a printing device (600), consistent with the disclosed implementations. As shown in FIG. 6, the printing device (600) includes a print engine (220) installed on the cart (210). As before, the print engine (220) includes the components for selectively apply a printing material, such as ink or toner, to a print medium, such as paper, to produce a hardcopy document based on digital data provided to the print engine (200) as a print job. The print engine (220) also includes its own print medium supply trays (406). In FIG. 6, two such print medium supply trays (406) are shown integrated into the print engine in a side-by-side configuration.

The cart (210), in this configuration, includes three print media trays (404), as in FIG. 4 described above. On the right side of the cart (210), in FIG. 6, a single access door (600) is provided. As shown in FIG. 6, this door (600) is large enough such that, when opened, it provides access to the print media feed path from each and all of the print media trays (404). Thus, if a print media jam occurs that must be cleared manually, the single access door (600) can be opened to provide immediate access to clear a jam at any of the print media trays (404). This can simply the process of locating and clearing a print media jam or mis-feed occurring the cart (210).

Similarly, the print engine (220) has another access door (602) above the single access door (600) of the cart (210). A latch (604) is provided for opening this access door (602) of the print engine (220).

The single access door (600) of the cart (210) has an upper edge (606) that is adjacent to, and may abut, a lower edge of the access door (602) in the print engine (220). A latch (608) for opening the single access door (600) of the cart (210) is located along this upper edge (606) of the single access door (600) in the cart (210).

Consequently, the single access door (600) is opened, in this example, by first opening the access door (602) of the print engine (220). Opening the door (602) of the print engine (220) reveals and facilitates access to the latch (608)

for the single access door (600) of the cart (210). Thus, the single access door (600) of the cart can be opened after and while the access door (602) of the print engine (220) is opened.

Figure 7:
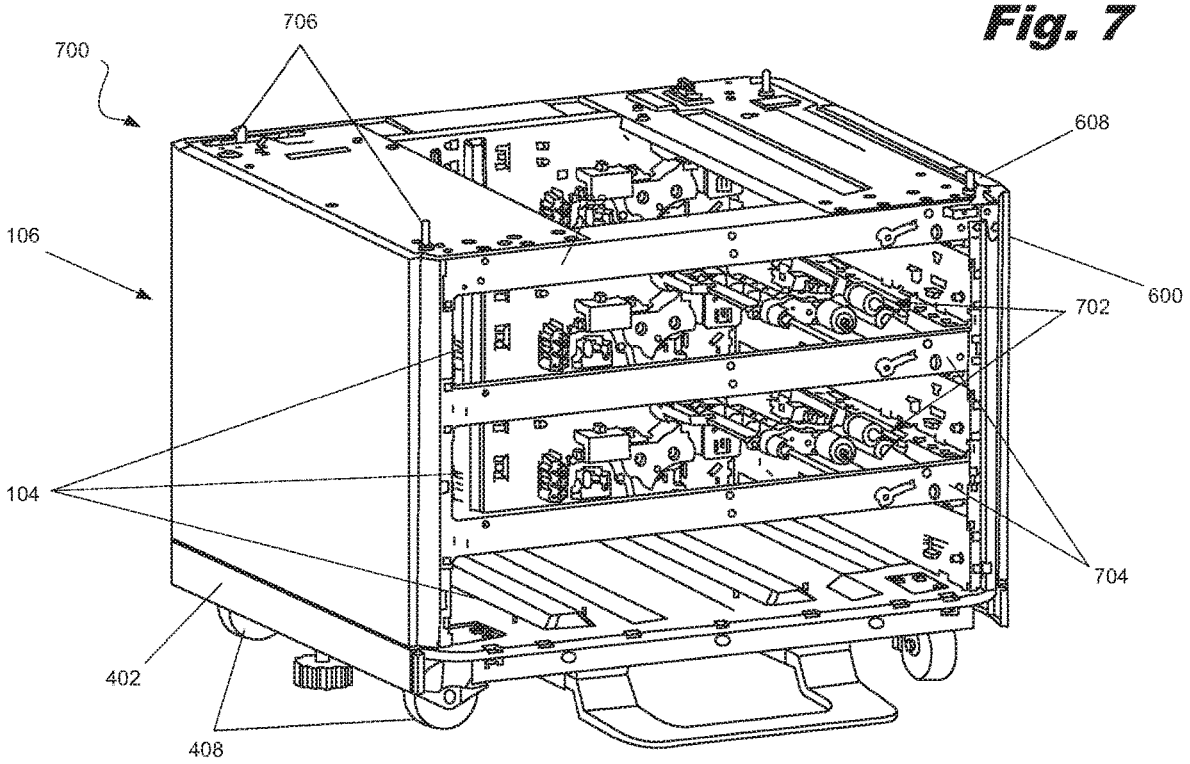
FIG. 7 is an illustration of the interior of a cart chassis, consistent with the disclosed implementations.

FIG. 7 is an illustration of the interior of a cart chassis, consistent with the disclosed implementations. As shown in FIG. 7, the cart (700) includes a chassis (106) and skateboard (402) with wheels (408) as described above. The cart (700) also includes the single access door (600) opened by latch (608) as described above.

As also shown in FIG. 7, each of the areas (104) for receiving an accessory tray includes a print media feeding system (702) for feeding print media from a print media tray installed in that location to a print engine installed on the cart. The upper platform of the cart (700) in FIG. 7 includes posts (706) for securing a print engine to the cart (700), as in some of the other illustrated examples.

A number of spanners (704) are provided across the front of the interior of the chassis (106) to divide the interior of the chassis (106) into the different areas (104) for receiving different accessory trays. As illustrated in FIG. 7, the cart (700) is provisioned to receive a configuration of three print media trays, one in each of the areas (104). Each such print media tray would then interface with the print media feeding system (702) in that area (104) so as to feed print media to a print engine installed on the cart (700).

If, however, the cart (700) is to be configured differently, it is relatively easy to remove components from the cart (700) as shown in FIG. 7 to accommodate a different configuration of accessory trays. For example, to achieve the configuration shown in FIG. 5 of a single print media tray installed over a storage tray, the cart (700) of FIG. 7 would be modified as follows.

The lower spanner (704) would be removed. Additionally, the print media feeding systems (702) in each of the two lower areas (104) of the cart would also be removed. This would allow for a larger storage tray to be installed occupying both of the two lower areas (104) of the cart (700). Removal of the print media feeding systems includes removal of the print media rail systems. A larger diameter wheel rail system is then installed to support the double-height storage tray.

Due to the ease of removing these components, the cart (700) of FIG. 7 can be mass produced and then readily adapted to different configurations of accessory trays as desired by different purchasers. Consequently, it is not necessary to manufacture different carts for each possibly desired configuration of accessories.

Also because the accessory trays described herein are modular, any such tray can be installed in the different areas (104) of the cart without needing to be specifically manufactured for that location The preceding description has been presented only to illustrate and describe examples of the principles described. This description is not intended to be exhaustive or to limit these principles to any precise form disclosed. Many modifications and variations are possible in light of the above teaching.

What is claimed is:

1. A cart chassis comprising:

a plurality of removable spanners to divide the chassis into multiple areas inside the chassis;

a first area of the multiple areas to accommodate a first type of modular accessory tray including a print media feeding system, and a second area of the multiple areas to accommodate a second type of modular accessory tray without a print media feeding system; and an upper platform of the chassis to support a print engine.

2. The cart chassis of claim 1, further comprising an uninterrupted surface spanning between adjacent accessory trays.

3. The cart chassis of claim 1, further comprising two of the first type of modular accessory trays, each of the two first type of modular accessory trays comprising a print media tray to contain a supply of a print medium, the print media trays being openable in a direction toward a front of the chassis for loading the print medium in the print media trays.

4. The cart chassis of claim 3, further comprising a single access door on a side of the chassis providing access for clearing a print medium jam at either of the two print media trays.

5. The cart chassis of claim 1, wherein the first type of modular accessory tray is a print media tray to contain a supply of a print medium and the second type of modular accessory trays is a storage tray, both trays being openable in a direction toward a front of the chassis for access to an interior of either tray.

6. The cart chassis of claim 1, further comprising a skateboard supporting the chassis, the skateboard comprising wheels to facilitate movement of the chassis.

7. The cart chassis of claim 1, wherein the plurality of removeable spanners are removeable to adjust a size of the multiple areas on the interior of the chassis for receiving different sizes of accessory trays.

8. A printing device comprising:

a print engine;

a cart chassis, the cart chassis comprising:

a plurality of removable spanners to divide the cart chassis into multiple areas inside the chassis;

a first area of the multiple areas to accommodate a first type of modular accessory tray including a print media feeding system, and a second area of the multiple areas to accommodate a second type of modular accessory tray without a print media feeding system; and an upper platform of the chassis to support the print engine;

wherein the two modular accessory trays are sized for installation in the multiple areas inside the chassis.

9. The printing device of claim 8, further comprising two of the first type of modular accessory trays each including a print media feeding system to feed print media from a print media tray installed in a corresponding area inside the chassis to the print engine, each print media feeding system being removable to accommodate instead a storage tray in the corresponding area inside the chassis.

10. The printing device of claim 8, further comprising two of the first type of modular accessory trays each including a print media tray to contain a supply of a print medium for feeding to the print engine, the print media trays being openable in a direction toward a front of the chassis for loading the print medium in the print media trays.

11. The printing device of claim 10, the cart chassis further comprising a single access door on a side of the chassis providing access for clearing a print medium jam at either of the two print media trays.

12. The printing device of claim 11, wherein the print engine comprises another access door, wherein a latch for opening the single access door of the chassis is accessible after opening the access door of the print engine.

13. The printing device of claim 8, wherein the first type of modular accessory trays is a print media tray to contain a supply of a print medium and the second type of modular accessory tray is a storage tray.

14. A method for customizing a cart of a printing device, the cart comprising a chassis having a plurality of removable spanners to divide the cart chassis into multiple areas inside the chassis, the method comprising:

installing a first type of modular accessory tray inside the chassis, the first type of modular accessory tray including a print media feeding system, installing a second type of modular accessory tray inside the chassis, wherein the first type of modular accessory is a print media tray to supply a print medium and the second type of modular accessory tray is a storage tray to provide storage space.

15. The method of claim 14, wherein installing the second type of modular accessory tray includes removing a print media feeding system from internal chassis areas to accommodate installation of a storage tray.

* * * * *